US007753976B2

(12) United States Patent
Hyun et al.

(10) Patent No.: US 7,753,976 B2
(45) Date of Patent: Jul. 13, 2010

(54) DUST COLLECTING DEVICE FOR VACUUM CLEANER

(75) Inventors: Kie Tak Hyun, Changwon-si (KR); Young Bok Son, Changwon-si (KR); Kyeong Seon Jeong, Changwon-si (KR); Il Joong Kim, Gyeongsangnam-do (KR); Sung Hwa Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/990,402

(22) PCT Filed: Aug. 17, 2005

(86) PCT No.: PCT/KR2005/002691

§ 371 (c)(1),
(2), (4) Date: Apr. 3, 2009

(87) PCT Pub. No.: WO2007/021045

PCT Pub. Date: Feb. 22, 2007

(65) Prior Publication Data

US 2010/0000185 A1 Jan. 7, 2010

(51) Int. Cl.
*B01D 45/00* (2006.01)

(52) U.S. Cl. ..... 55/343; 55/345; 55/346; 55/424; 55/428; 55/349; 55/DIG. 3; 15/352; 15/353

(58) Field of Classification Search ..... 55/343, 55/345, 346, 424, 428, DIG. 3; 15/352, 353
See application file for complete search history.

(56) References Cited

U.S. PATENT DOCUMENTS 6,406,505 B1 * 6/2002 Oh et al. ..... 55/337
6,482,252 B1 * 11/2002 Conrad et al. ..... 96/57
6,599,348 B2 * 7/2003 Chosnek et al. ..... 95/271
7,419,521 B2 * 9/2008 Oh et al. ..... 55/337
2002/0011052 A1 * 1/2002 Oh et al. ..... 55/424
2005/0172584 A1 * 8/2005 Oh et al. ..... 55/345
2005/0172585 A1 8/2005 Oh et al.

(Continued)

FOREIGN PATENT DOCUMENTS

EP 1 707 096 10/2006

(Continued)

*Primary Examiner*—Jason M Greene
*Assistant Examiner*—Dung Bui
(74) *Attorney, Agent, or Firm*—McKenna Long & Aldridge LLP

(57) ABSTRACT

Object of the present invention is to provide a dust collecting device (10) for a vacuum cleaner of which dust collecting performance is improved. The dust collecting device (100) of the present invention includes a primary cyclone unit (200) having two primary cyclones (210, 220), arranged in parallel, for separating dust by a cyclone principle, a secondary cyclone unit (300) having at least two secondary cyclones (310, 320), which receives air from the primary cyclones (210, 220) on an outer side of the primary cyclones (210, 220) for separating dust by the cyclone principle, and a dust container (110) having the primary cyclone unit (200) and the secondary cyclone unit (300) mounted thereto, and a primary dust collecting space for storing the dust separated at the primary cyclone unit (200), and at least one secondary dust collecting space for storing the dust separated at the secondary cyclone unit (300) formed therein.

19 Claims, 9 Drawing Sheets

U.S. PATENT DOCUMENTS

| | | | | |
|---|---|---|---|---|
| 2005/0172586 | A1 | 8/2005 | Oh et al. | |
| 2005/0229554 | A1* | 10/2005 | Oh et al. | 55/346 |
| 2005/0251951 | A1* | 11/2005 | Oh et al. | 15/353 |
| 2006/0230717 | A1* | 10/2006 | Oh et al. | 55/343 |

FOREIGN PATENT DOCUMENTS

| | | |
|---|---|---|
| GB | 2 372 435 | 8/2002 |
| GB | 2 399 780 | 9/2004 |
| GB | 2 406 067 | 3/2005 |
| JP | 2004-135700 | 5/2004 |

* cited by examiner

[Fig. 1]
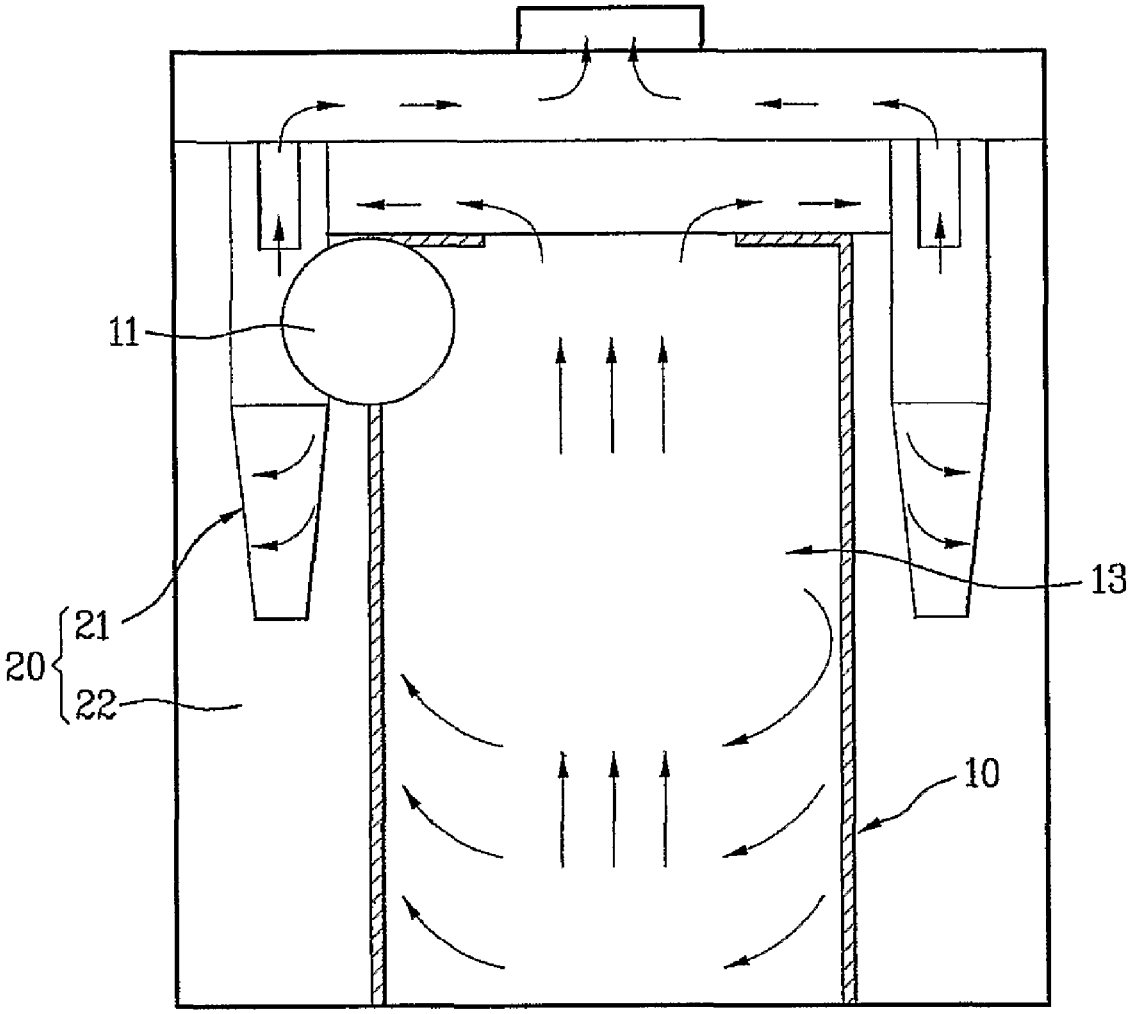

[Fig. 2]
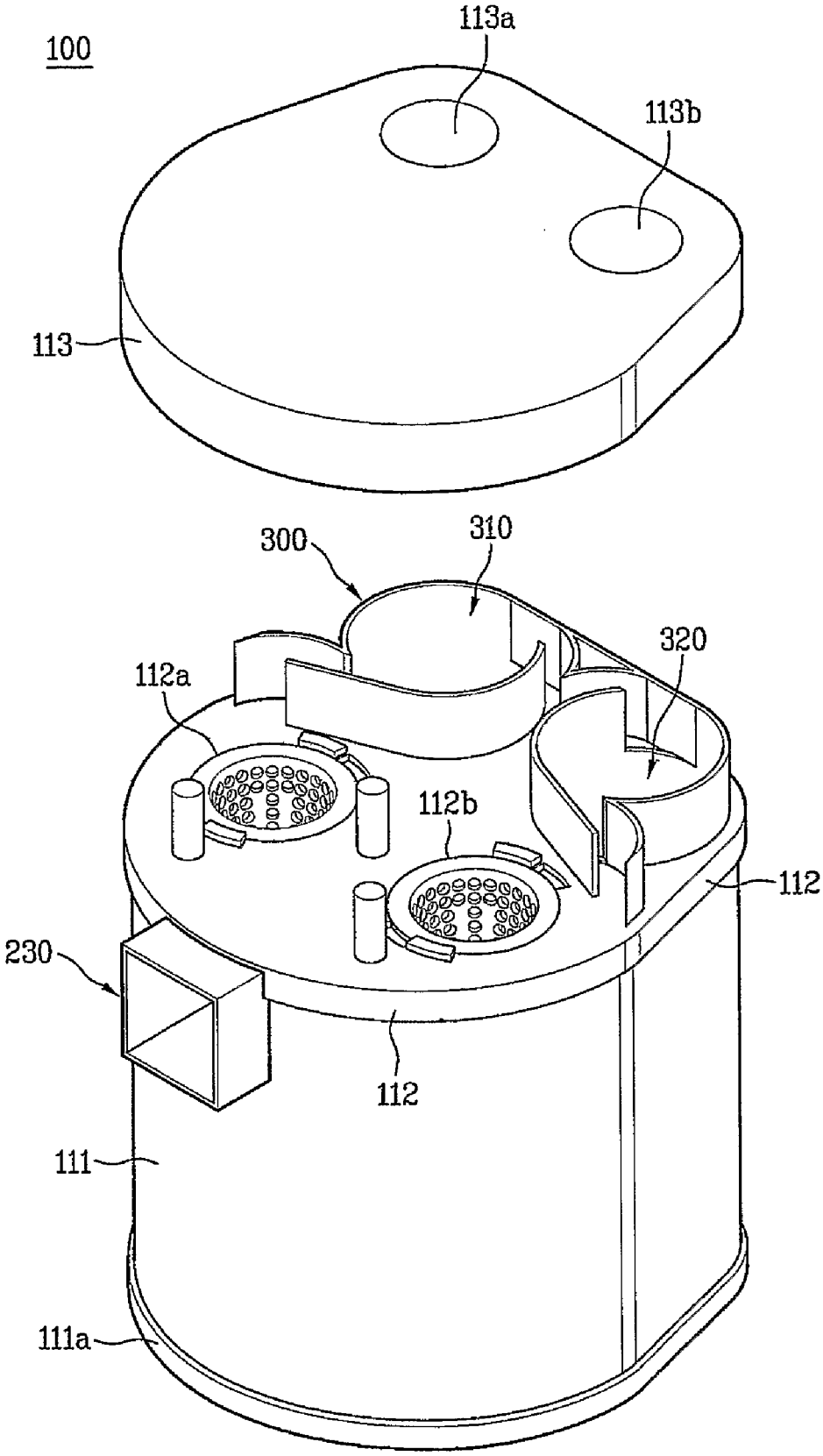

[Fig. 3]
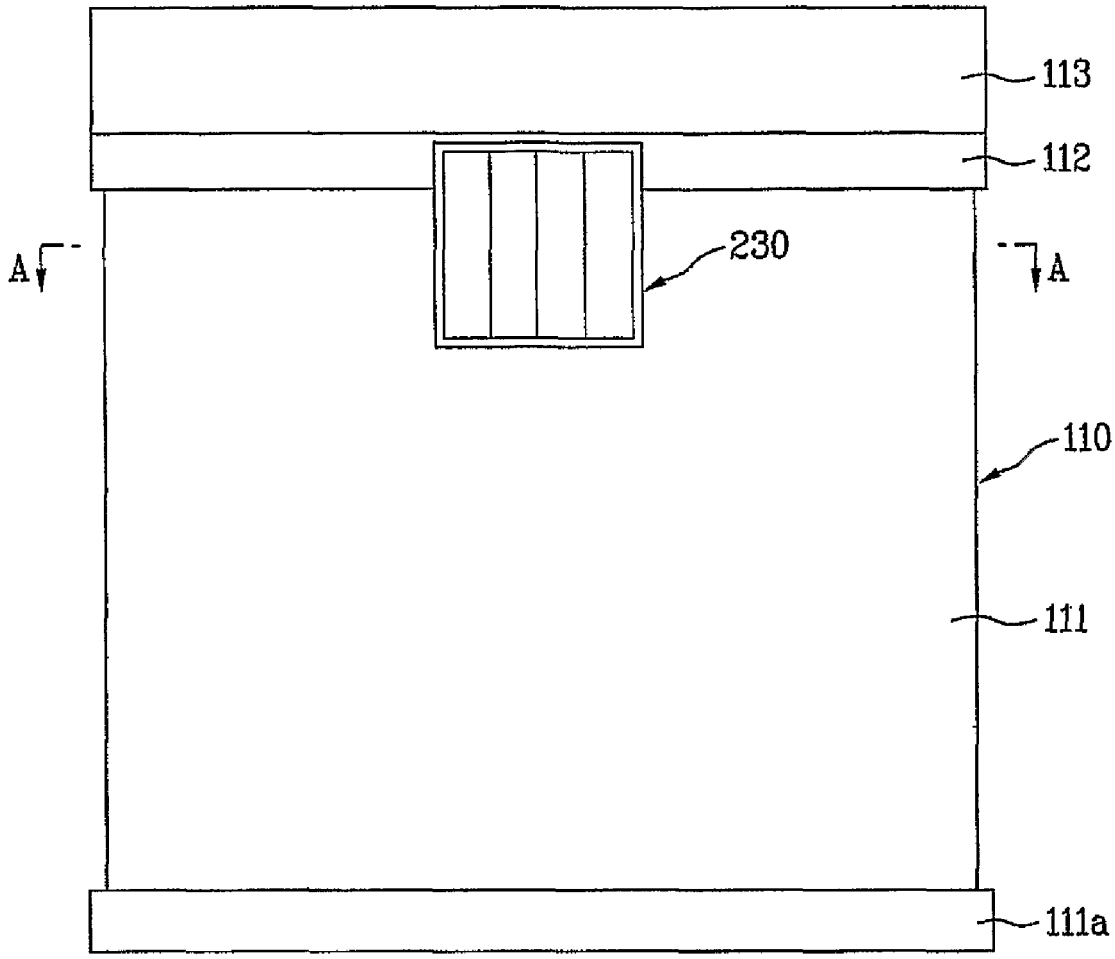

[Fig. 4]
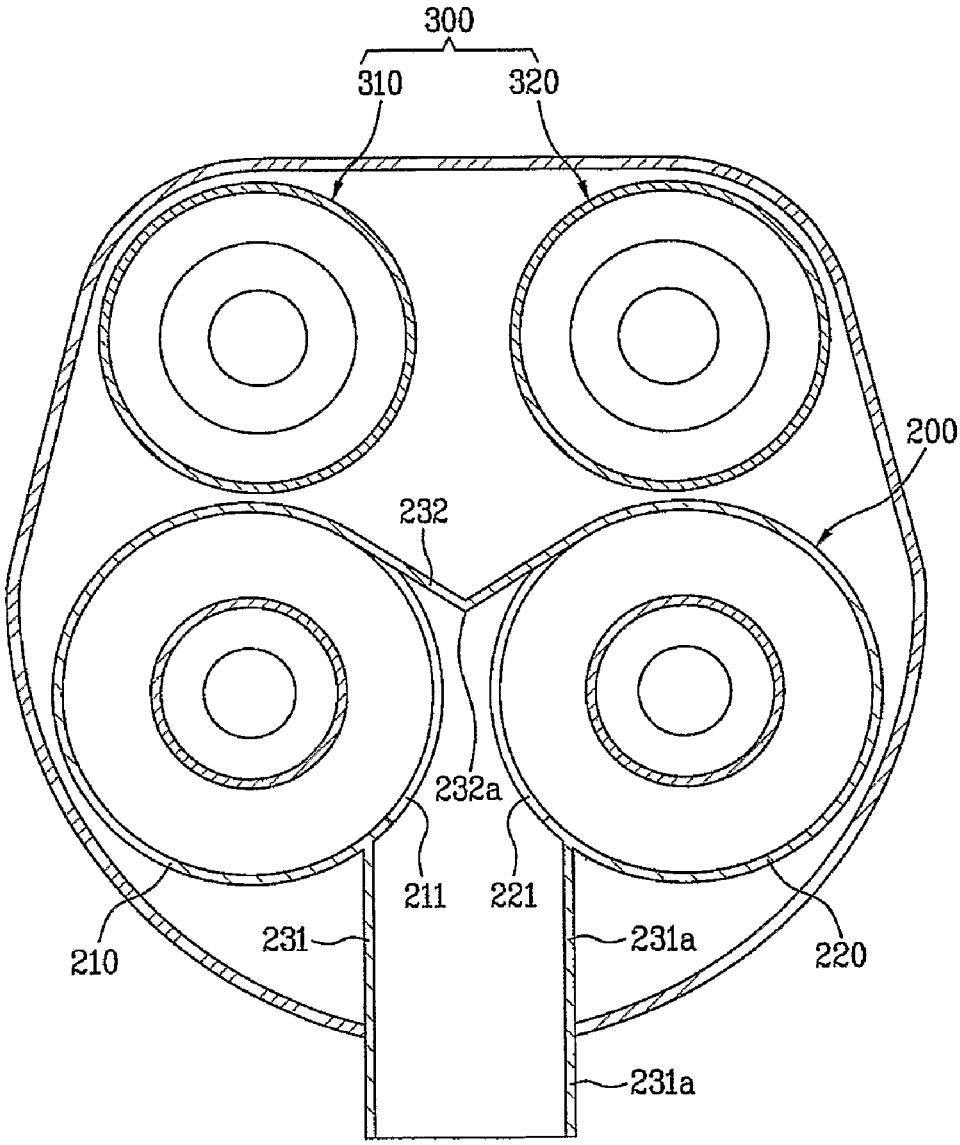

[Fig. 5]
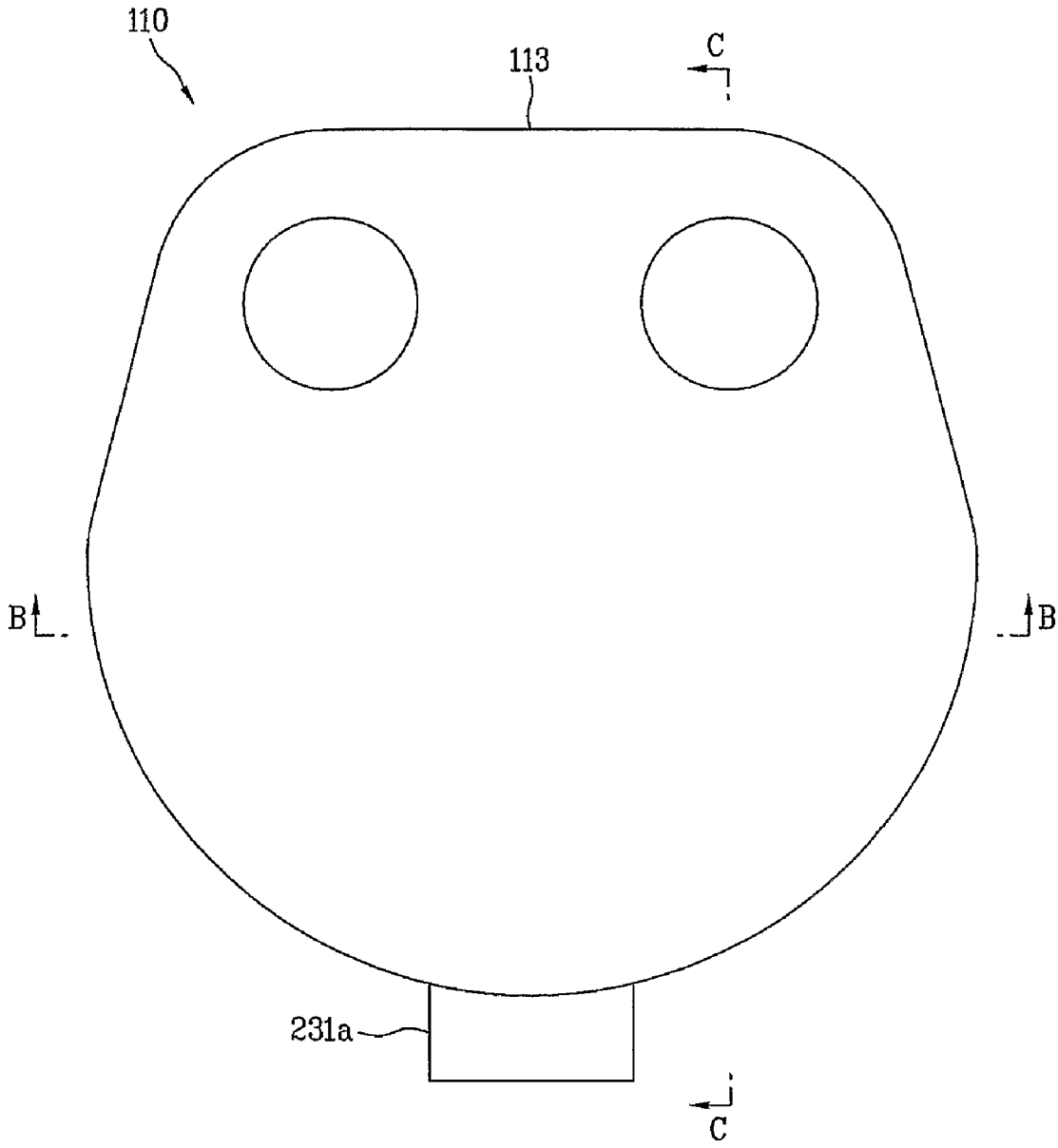

[Fig. 6]
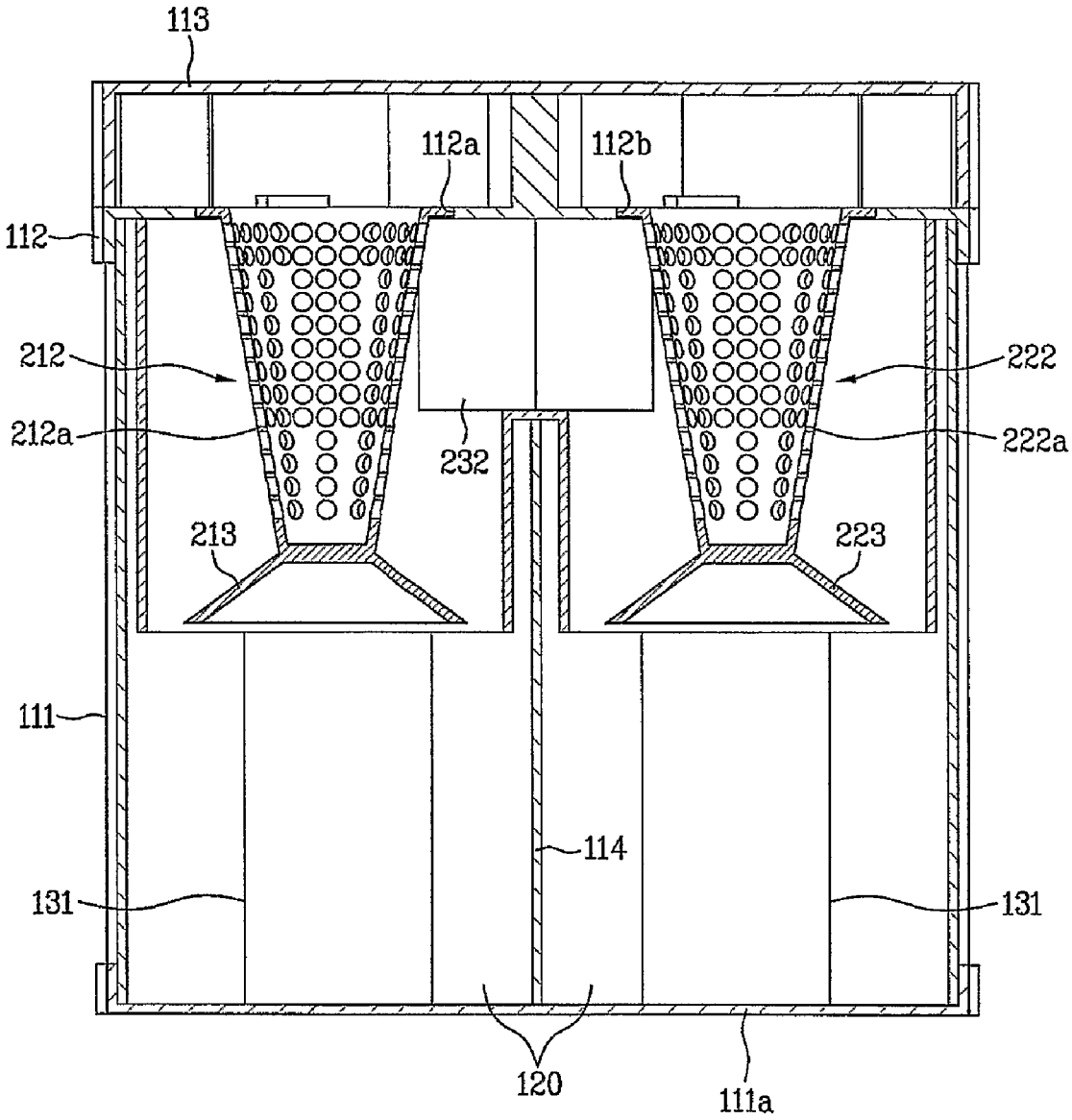

[Fig. 7]
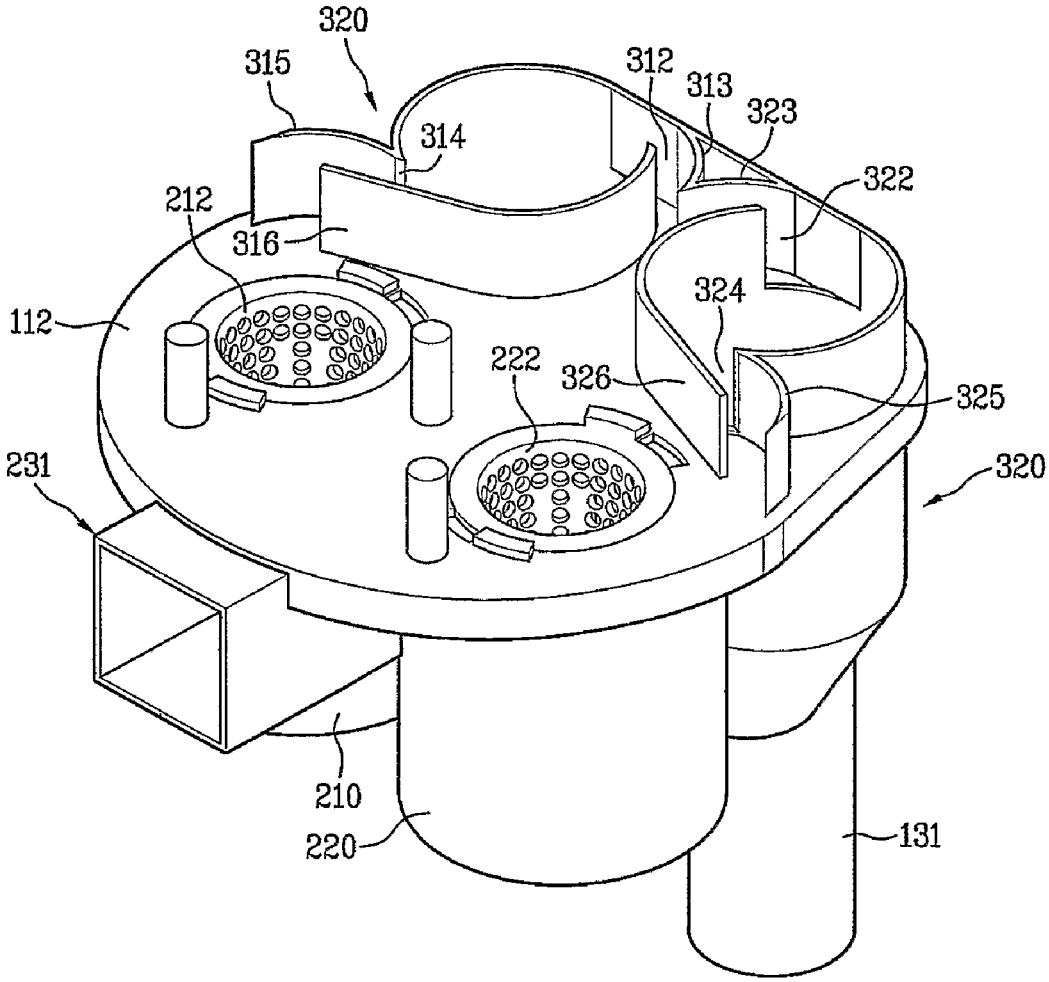

[Fig. 8]
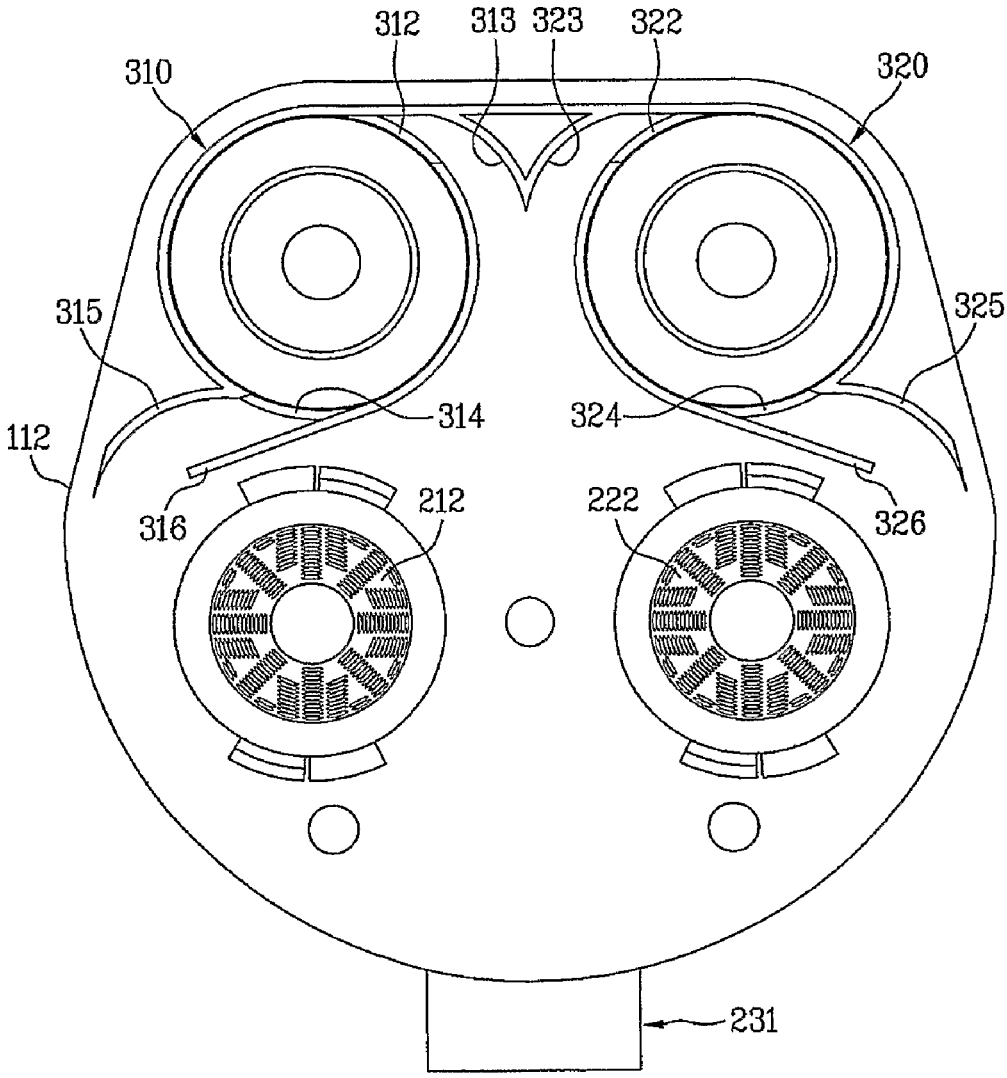

[Fig. 9]
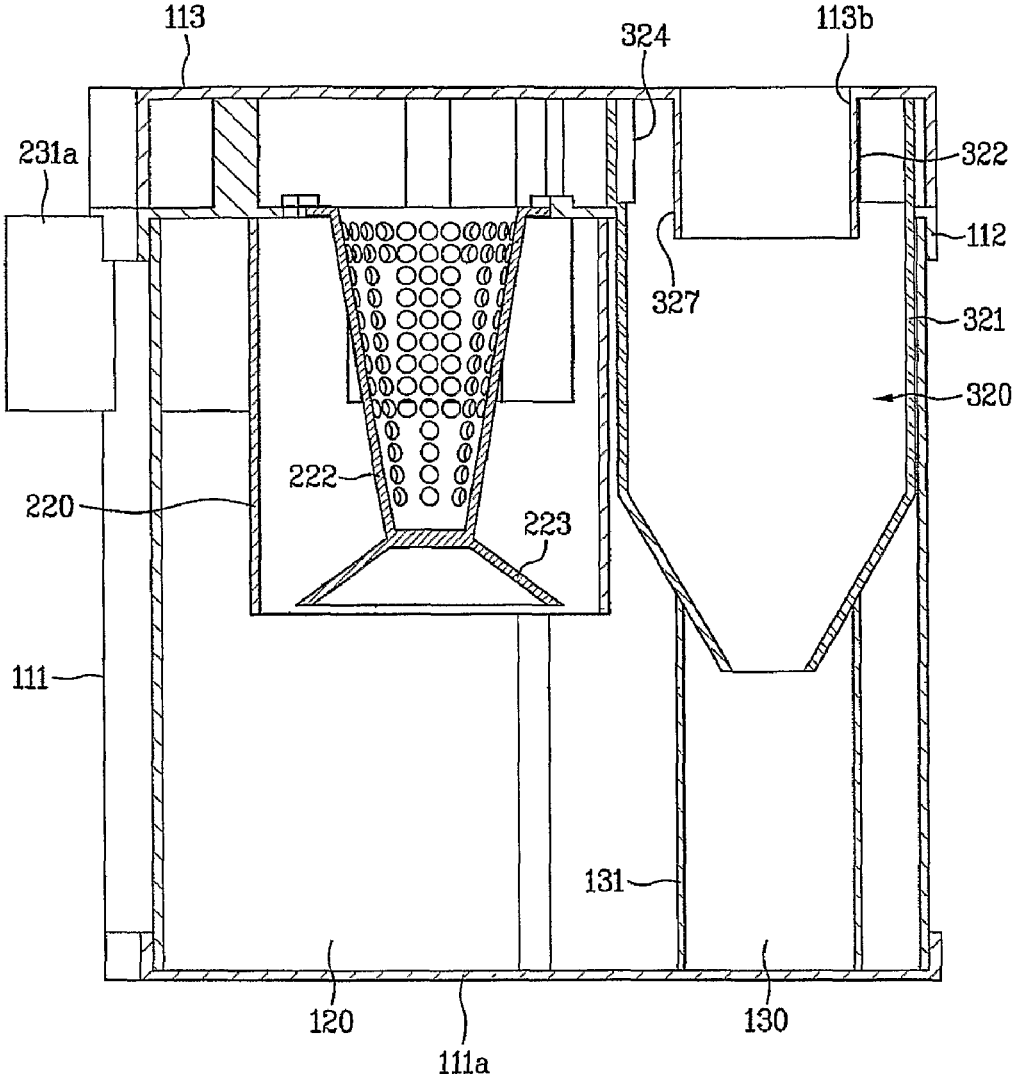

DUST COLLECTING DEVICE FOR VACUUM CLEANER

This application claims the benefit of PCT Patent Application No. PCT/KR2005/002691, filed Aug. 17, 2005, which is hereby incorporated by reference in its entirety.

TECHNICAL FIELD

The present invention relates to a dust collecting device for a vacuum cleaner, and more particularly, to a dust collecting device for a vacuum cleaner which collects dust by a cyclone principle.

BACKGROUND ART

In general, the cyclone dust collecting device is applied to a vacuum cleaner, for separating foreign matters, such as dust, from circulating air, to collect the dust.

The cyclone principle utilizes a difference of centrifugal forces for separating foreign matters, such as dust, from air circulating in a spiral.

Recently, the cyclone dust collecting device, collecting dust by Using the cyclone principle, is generally applied to the vacuum cleaner owing to advantages, of the cyclone dust collecting device in that dust collecting performance is good and dust can be removed easily compared to a bag-type dust collecting device in which a dust bag is mounted in an air flow passage for collecting dust.

A related art dust collecting device for a vacuum cleaner will be described with reference to FIG. 1.

The related art dust collecting device is provided with a primary cyclone dust colleting unit 10 for drawing contaminated air containing dust and collecting comparatively large sized particles of the dust therefrom, and a secondary cyclone dust collecting unit 20 on an outside of the primary cyclone dust colleting unit 10 for collecting comparatively small sized particles of the dust.

The primary cyclone dust collecting unit 10, a cylindrical container having a bottom in close contact with a bottom of the dust collecting device, has a suction pipe 11 in a side surface of an upper portion for introduction of contaminated air containing foreign matters in a tangential direction of an inside wall of the primary cyclone dust collecting unit, and a discharge opening 12 at a center of a top for discharging air cleaned primarily.

According to this, the primary cyclone dust collecting unit 10 has an upper space forming a primary, cyclone 13 for separating foreign matters by centrifugal force, and a lower space forming a primary dust storage portion 14 for storing foreign matters separated by the centrifugal force.

In the meantime, the air from the discharge opening 12 is introduced to the secondary cyclone dust collecting unit 20, and discharged upward after passed through a dust separating step, again.

In more detail, the secondary cyclone dust collecting unit 20 includes a plurality of small sized secondary cyclones 21 arranged in a circumferential direction around the upper portion of the primary cyclone dust collecting unit 10, and a secondary dust storage portion 22 for storing dust separated at the secondary cyclone dust collecting unit 21.

The secondary dust storage portion 22 is under me secondary cyclones 21 around the primary dust storage portion. The primary dust storage portion 14 and the secondary dust storage portion 22 are separated by an outside wall of me primary cyclone dust collecting unit 10.

However, the related art dust collecting device has a problem in that a dust collecting performance of the primary cyclone dust collecting unit that collects a major portion of the dust is poor because the foreign matters, such as dust, is separated and collected only with single primary cyclone.

Moreover, since the suction pipe is asymmetric, which is extended from one side of the related art dust collecting device toward a center portion thereof, the related art dust collecting device has problems in that the suction pipe is long, air tightness between the cleaner body and the dust collecting device is poor, and a air flow resistance is high due to the bent air flow passage.

Moreover, Because me primary cyclone and the primary dust storage portion are formed as one unit in the cylindrical primary cyclone dust collecting unit having the same upper and lower inside diameters, the dust flies up from the primary dust storage portion toward an upper side of the primary cyclone by the spiral circulation of air in the primary cyclone, thereby leading the dust collecting performance poor.

Furthermore, in the related art dust collecting device, because the secondary dust storage portion is around the primary dust storage portion, if a capacity of the primary dust storage portion is made greater, a width of the secondary dust storage portion becomes smaller, causing difficulty both in removal of foreign matters from a wall of he secondary dust storage portion, and checking an amount of dust accumulated in the primary dust storage portion due to the secondary dust storage portion that shades the primary dust storage portion.

DISCLOSURE OF INVENTION

Technical Problem

An object of the present invention is to provide a dust collecting device for a vacuum cleaner, which has an improved dust collecting performance.

Technical Solution

An object of the present invention can be achieved by providing a dust collecting device for a vacuum cleaner including a primary cyclone unit having two primary cyclones arranged in parallel, for separating dust by a cyclone principle, a secondary cyclone unit having at least two secondary cyclones which receives air from the primary cyclones on an outer side of the primary cyclones for separating dust by the cyclone principle, and a dust container having the primary cyclone unit and the secondary cyclone unit mounted thereto, and a primary dust collecting space for storing the dust separated at the primary cyclone unit, and at least one secondary dust collecting space for storing the dust separated at the secondary cyclone unit formed therein.

The dust container has a symmetric exterior in a left/right direction.

The primary cyclones are connected to a suction air guiding portion which guides air containing dust to the primary cyclones, and the suction air guiding portion is symmetric with respect to a plane of symmetry of the dust container.

Preferably, the primary cyclones are provided in the dust container, and arranged in symmetry with respect to the plane of symmetry of the dust container.

The primary cyclones may be provided in an up/down direction in the dust container.

The suction air guiding portion includes a suction pipe having a suction opening provided to an upper outside circumferential surface of the dust container, and a guide wall for guiding the air guided by the suction pipe to insides of the primary cyclones.

The primary cyclones each includes a first inlet in an upper outside circumferential surface between the guide wall and the suction pipe for receiving the air guided by the guide wall.

The guide wall is opposite to the suction pipe, and has one end, and the other end connected to one side circumference of one of the first inlets, and one side circumference of the other one of the first inlets respectively, and a middle portion projected toward the suction pipe for splitting the air supplied by the suction pipe in two sides toward the first inlets.

The primary cyclones have an upper ends connected to an upper cover openably provided to a top of the dust container, wherein the upper cover has two air discharge holes formed in an up/down direction in correspondence to the primary cyclones.

Preferably, the primary dust collecting chamber which forms the primary dust collecting space has an inside circumferential surface surrounding an outside circumferential surface of the primary cyclone unit, and the primary cyclones have bottoms spaced a predetermined height away from a bottom of the primary dust collecting chamber.

At least a portion of the outside circumferential surface of each of the primary cyclones is spaced a predetermined distance away from the inside wall of the primary dust collecting chamber, such that the dust passed through a lower end of the primary cyclones spreads along an inside wall of the primary dust collecting chamber.

The dust container includes an openable bottom which forms a bottom of the secondary dust collecting chamber which forms the secondary dust collecting space.

Preferably, the dust collecting device further includes hollow air discharge members provided in the primary cyclones respectively, each having pass through holes of predetermined sizes in an outside circumferential surface for discharging air.

In the meantime, each of the at least one secondary cyclone includes a secondary cyclone body in the dust container, having a second inlet in an outside circumferential surface, and a first guide member having one end connected to a circumference of the second inlet for guiding the air from the primary cyclones to a tangential Direction of an inside circumferential surface of the secondary cyclone body.

Preferably, the at least one secondary cyclone includes two secondary cyclones arranged in symmetry with respect to a plane.

Preferably, the first guide members of the two secondary cyclones have the other ends extended to a direction the air from the primary cyclone unit blowing thereto until the other ends are connected to each other, for splitting the air blowing from the primary cyclone unit into two sides toward the second inlets.

The secondary cyclone unit may further include a third inlet in an outside circumferential surface of the secondary cyclone body spaced in a circumferential direction from the first inlet, and a second guide member extended from one side circumference of the third inlet for guiding an air flow.

The secondary cyclone unit may further include a third guide member connected to the other side circumference of the third inlet to form a flow passage for guiding the air to the third inlet together with the second guide member.

The dust container includes a secondary dust container provided between an underside of the secondary cyclone body and the bottom of the dust container, to form a secondary dust collecting space.

Advantageous Effects

The two parallel primary cyclones improve a dust collecting performance of the primary cyclone together with an entire performance of the dust collecting device.

BRIEF DESCRIPTION OF THE DRAWINGS

The accompanying drawings, which are included to provide a further understanding of the invention, illustrate embodiment(s) of the invention and together with the description serve to explain the principle of the invention. In the drawings;

FIG. 1 illustrates a section of a related art cyclone dust collecting device;

FIG. 2 illustrates a perspective view of a dust collecting device in accordance with a preferred embodiment of the present invention;

FIG. 3 illustrates a front view of a dust collecting device in accordance with a preferred embodiment of the present invention;

FIG. 4 illustrates a cross section along a line A-A in FIG. 3;

FIG. 5 illustrates a plan view of a dust collecting device in accordance with a preferred embodiment of the present invention;

FIG. 6 illustrates a longitudinal section along a line B-B in FIG. 5;

FIG. 7 illustrates a perspective view of an upper cover of a dust collecting device of the present invention;

FIG. 8 illustrates a plan view of an upper cover of a dust collecting device of the present invention; and FIG. 9 illustrates a longitudinal section along a line C-C in FIG. 5.

BEST MODE FOR CARRYING OUT THE INVENTION

Reference will now be made in detail to the preferred embodiments of the present invention, examples of which are illustrated in the accompanying drawings. Wherever possible, the same names and reference numbers will be used throughout the drawings to refer to the same or like parts, and repetitive description of which will be omitted.

As one embodiment of a vacuum cleaner having a dust collecting device in accordance with a preferred embodiment of the present invention applied thereto, a canister type vacuum cleaner will be described.

The vacuum cleaner includes a suction nozzle for drawing air containing foreign matters while moving along a floor to be cleaned; a cleaner body provided separate from the suction nozzle, and a connection pipe connected between the suction nozzle and the cleaner body for guiding contaminated air from the suction nozzle to the cleaner body.

The suction nozzle has a predetermined size of nozzle suction opening in a bottom for drawing dust from the floor by air suction force generated at the cleaner body.

Mounted inside of the cleaner body, there are an electric unit for controlling the vacuum cleaner, and a motor-fan assembly for drawing air.

In more detail, the cleaner body has a hose connection portion at a front upper center for connecting the connection pipe thereto, wheels rotatably mounted at opposite sides of a rear of the cleaner body for smooth moving of the cleaner body on the floor, and a caster at a front portion of a bottom of the cleaner body for changing a direction of the cleaner body.

In the meantime, the cleaner body has the dust collecting device in accordance with a preferred embodiment of the present invention detachably mounted thereto for separating and collecting foreign matters, such as dust.

Air from the dust collecting device passes a predetermined air discharge passage in the cleaner body, and the motor-fan assembly, and is discharged to an outside of the cleaner body.

The dust collecting-device may be mounted to a rear portion of the cleaner body or a front portion of the cleaner body.

For this, the cleaner body has a dust collecting device mounting portion at the front portion or rear portion of the cleaner body for mounting the dust collecting device.

Between the hose connection portion and the dust collecting device mounting portion, there is a suction passage passed through the upper portion of the cleaner body in a front/rear direction for guiding the air containing dust.

The dust collecting device 100 in accordance with a preferred embodiment of the present invention will be described with reference to a case the dust collecting device is mounted to the rear portion of the cleaner body.

FIG. 2 illustrates a perspective view of a dust collecting device in accordance with a preferred embodiment of the present invention, and FIG. 3 illustrates a front view of a dust collecting device in accordance with a preferred embodiment of the present invention.

Referring to FIGS 2 and 4, the dust collecting device includes a primary cyclone unit 200 and a secondary cyclone unit 300 for separating dust by a cyclone principle, and a dust container 110 in which the first cyclone unit and the second cyclone unit are provided.

The dust container 110 has dust collecting spaces for storage of dust separated by the primary clone unit 200 and the secondary cyclone unit 300.

It is preferable that the dust container 110 has a symmetrical exterior in a left/right direction.

In more detail, the exterior of the dust container 110 is symmetry with respect to a predetermined plane of symmetry between one side portion and the other side portion of the dust container 110. The plane of symmetry of the dust container 110 is an imaginary plane which is vertical to a bottom of the dust container, and dividing the exterior of the dust container into two parts, equally.

The dust container 110 forms an exterior of the dust collecting device in accordance with a preferred embodiment of the present invention, and it is preferable that an upper portion of the dust container can be opened.

For this, the dust container 110 may include a dust container body 111 having an opened top, and an upper cover 112 for opening/closing the top of the body.

Accordingly, the upper cover 112 is openably provided to the top of the dust container 110.

Moreover, the upper cover 112 has a cap 113 so that the air from the primary cyclone unit 200 forms an air flow chamber of the air flowing toward the secondary cyclone unit 300.

It is preferable that the cap 113 is detachably provided to the upper cover 112.

The air cleaned at the secondary cyclone unit 200 is discharged upward through a top portion of the cap 113.

Though not shown, it is preferable that the dust container 110 includes an air discharge cover provided to an upper portion of the cap 113, for discharging air from the secondary cyclone unit to the air discharge flow passage in the cleaner body.

In the dust collecting device of the present invention, the primary cyclone unit 200 includes two primary cyclones 210, and 220 arranged in parallel, and the secondary cyclone unit includes at least one secondary cyclone 310, and 320 on an outer side of the primary cyclone unit.

The at least one secondary cyclone is provided to a downstream of the primary cyclone unit 200, for separating foreign matters, such as dust, from the air introduced to an inside of the at least one secondary cyclone from the primary cyclones 210 and 220.

The air from the primary cyclones 210 and 220 is introduced to the at least one secondary cyclone through an outside circumferential surface thereof and circulates in a spiral. That is, the at least one secondary cyclone draws air in an outside circumferential direction.

Referring to FIGS 4 to 6, the two primary cyclones 210, and 220 are connected to a suction air guide portion 230 for guiding the air containing dust to the primary cyclones 210 and 220.

The suction air guide portion 230 guides the air containing dust from an outside of the dust container 110, more specifically, from the suction flow passage of the cleaner body to insides of the primary cyclones 210 and 220.

For this, the suction air guide portion 230 is connected to the front of the cleaner body, more specifically, the suction air flow, passage which passes through the upper center of the cleaner body in a front/rear direction.

In this instance, it is preferable that the suction air guide portion 230 is symmetry with respect to the plane of symmetry of the dust container 110 in a left/right direction.

According to this, the plane of symmetry of the dust container 110 includes an axis of the suction air guide portion 230. On an inside of the dust container 110 in symmetry in the left/right direction, there are the primary cyclones 210 and 220 arranged symmetry with respect to the plane of symmetry of the dust container 110.

In the embodiment, the primary cyclones 210 and 220 have cylindrical shapes, and are provided on an inside of the dust container 110 in an up/down direction.

In more detail, the two primary cyclones 210 and 220 are provided to the inside of a body 111 of the dust container such that axes of the two primary cyclones 210 and 220 are vertical. The primary cyclones 210 and 220 are provided to positions spaced away from each other.

The suction air guide portion 230 includes a suction pipe 231 to be connected to the suction flow passage, and a guide wall 232 for guiding the air guided by the suction pipe 231 to insides of the primary cyclones 210 and 220.

The suction pipe 231 has an inlet 231*a* at an upper portion of an outside circumference of the dust container 110, wherein the inlet 231*a* is at an upper center of the outside circumference of the body 111 of the dust container when the dust container 110 is seen along an axis line of the suction pipe 231.

Each of the primary cyclones 210 and 220 has a first inlet 211, or 221 in an upper outside circumference thereof. The first inlet 211 or 221 is provided between the guide wall 232 and the suction pipe, for introduction of the air guided by the guide wall 232 to insides of the primary cyclones 210 and 220 through the first inlets 211, and 221 of the primary cyclones 210 and 220, respectively.

Alike the embodiment, in a case the inlet 231*a* of the suction pipe is provided to the upper front of the dust container 111, an axis of the suction pipe 231 passes the outside circumferential surface of the body 111 of the duct container in a front/rear direction.

The suction pipe 231 is extended toward the guide wall 231 such that the guide wall 232 is opposite to the suction pipe 231.

The guide wall 232 has one end and the other end connected to one side circumference of one of the first inlets 211, and 221, and one side circumference of the other one of the first inlets 211, and 221. A middle portion 23*a* of the guide wall is projected toward the suction pipe 231 for splitting the air supplied through the suction pipe 231 into two portions toward the first inlets 211, and 221.

In a case the exterior of the dust container 110 is divided into a left side portion and a right side portion with respect to the plane of symmetry like the embodiment, the primary cyclones 210 and 220 are provided to left/right sides of the plane of symmetry, and the first inlets are provided to one side and the other side of the guide wall 232.

For convenience of description, of the primary cyclones 210 and 220, if the primary cyclones 210 on the left side of the plane of symmetry is called as a left side cyclone, and the primary cyclones 220 on the right side of the plane of symmetry is called as a right side cyclone 220, the first inlets 211, and 221 are formed in a right side outside circumference of the left side cyclone 210 and in a left side outside circumference of the right side cyclone 220, respectively.

According to this, the left end of the guide wall 232 is connected to a rear circumference of the first inlet 211 formed in the outside circumferential surface of the left side cyclone 210, and the right end of the guide wall 232 is connected to a rear circumference of the first inlet 221 formed in an outside circumferential surface of the right side cyclone 220.

The middle portion 232*a* of the guide wall has a shape projected forward toward the suction pipe 231, i.e., diverged the more as it goes to a rear side the more.

Referring to FIGS 6 to 8, on an inside of the dust container 110, there are dust collecting spaces for storing dust separated by the primary cyclone unit 200 and the secondary cyclone unit 300.

In more detail, the dust container 110 includes a primary dust collecting chamber 120 for forming a primary dust collecting space to store dust separated by the primary cyclone unit, and a secondary dust collecting chamber 130 for forming a secondary dust collecting space to store dust separated by the secondary cyclone unit 300.

It is preferable that a bottom of the dust container 110 forms a bottom of the first dust collecting chamber 120 and the secondary dust collecting chamber 130, and the bottom of the dust container 110, i.e., the bottom of the body 111 of the dust container is openable for removal of the dust.

In the embodiment, an outside wall of the dust container forms an outside wall of the primary dust collecting chamber 120, and the primary cyclone unit is provided to an inside of the primary dust collecting chamber 120. In other words, an inside circumferential surface of the dust container 110 forms an inside circumferential surface of the primary dust collecting chamber 120, and the inside circumferential surface of the primary dust collecting chamber 120 surrounds the outside circumferential surface of the primary cyclone unit 200.

In other words, an outside circumferential surface of the primary cyclones 210, and 220 are in contact with the inside circumferential surface of the primary dust collecting chamber 120, or surrounded by the primary dust collecting chamber 120 in a state the outside circumferential surface of the primary cyclones 210, and 220 are not in contact with the inside circumferential .surface of the primary dust collecting chamber 120. The contact, herein, is a concept including that the primary clones and the inside circumferential surface of the primary dust collecting chamber are formed as one body.

It is preferable that at least a portion of the outside circumferential surface of each of the primary cyclones 210, and 220 is spaced predetermined distance away from the inside wall of the primary dust collecting chamber 120. That is, it is preferable that the primary dust collecting chamber 120 has a cross sectional area greater than a cross sectional area of the primary cyclones 210, and 220.

Moreover, undersides of the primary cyclones 210, and 220 are spaced a pre-determined distance away from the bottom of the dust container 110 which forms the primary dust collecting chamber, and the primary cyclones 210, and 220 have bottoms opened fully, or with dust discharge holes (not shown) formed along a circumference of the bottom.

Accordingly, the foreign matters separated at the primary cyclones 210, and 220 by the cyclone principle pass the bottom of the primary cyclones 210, and 220 are stored in a lower space of the dust container 110.

Since the dust separated centrifugally while moving in a spiral at the inside of the primary cyclones 210, and 220 spreads along an inside wall of the primary dust collecting chamber 120 by centrifugal force as the dust passes the bottom of the primary cyclones 210, and 220, leading to minimize discharge of dust that is not separated laden on an air flow discharged from the primary cyclones 210, and 220, the dust separating performance of the primary cyclones 210, and 220, and the dust storage capacity of the primary dust collecting chamber 120 are improved.

In addition to above, it is preferable that the dust container 110 includes a partition wall 114 under the suction air guide portion 230, wherein the partition wall 114 prevents the dust separated by the left side cyclone 210 and the dust separated by the right side cyclone 220 from giving influences to each other, thereby minimizing fly and noise of the dust.

It is preferable that the partition wall 114 is in the plane of symmetry, and prevents the dust separated by the left side cyclone 210 and the dust separated by the right side cyclone 220 from mixing with each other.

The primary cyclones 210 and 220 discharge air cleaned primarily to an upper side of the primary cyclones 210, and 220. For this, the upper cover 112 has two air outlets 112*a* and 112*b* formed therein side by side in correspondence to the primary cyclones 210, and 220 passing through the upper cover 112 in an up/down direction.

The air outlets 112*a* and 112*b* have the same axes with the primary cyclones 210, and 220 respectively, and the air cleaned primarily at the primary cyclones 210, and 220 is discharged to an upper side of the upper cover 112 through the air outlets 112*a*, and 112*b*.

In the embodiment, upper ends of the primary cyclones 210, and 220 are connected to the upper cover 112 of the dust container 110.

The primary cyclones 210 and 220 may be detachably connected to the upper cover 112, or may be formed as one body with the upper cover 112.

According to this, if the user opens the upper cover 112, the primary cyclones 210, and 220 are separated from the body 111 of the dust container together with the upper cover 112, enabling easy cleaning of the primary cyclone unit 200.

In addition to this, it is preferable that the primary cyclones 210 and 220 have hollow air discharge members 212, and 222 provided to insides thereof, respectively.

In more detail, the air discharge members 212, and 222 are in communication with the air outlets 112*a* and 112*b*, and have pass through holes 212*a* and 222*a* of pre-determines sizes in outside circumferential surfaces for discharge of air, respectively.

Upper ends of the air discharge members 212 and 222 are opened and connected to the air outlets 112*a*, and 112*b* for enabling air discharge. It is preferable that the air discharge members 212 and 222 are detachably connected to the upper cover 112.

At bottom ends of the air discharge members 212, and 222, there are fly preventing members 213, and 223 each having a shape with a horizontal sectional area which becomes the greater as it goes to a lower side the more for minimizing fly of the dust stored in the primary dust storage portion 130 by the spiral air flow.

The air discharge members 212, and 222 each may have a cylindrical shape or a cone shape substantially with a cross sectional area which becomes the smaller as it goes to a lower side the more.

In the meantime, referring to FIGS. 7 to 9, the secondary cyclone unit is provided to rear side of the primary cyclone unit. Accordingly, the primary cyclone unit is provided to a front side of the dust container 110, and the secondary cyclone is provided to a rear side of the dust container 110.

As described before, the secondary cyclone unit includes at least one secondary cyclone for drawing the air from the primary cyclone unit in an outside circumferential direction and separated dust therefrom by the cyclone principle.

In one embodiment, the secondary cyclone unit includes two secondary cyclones 310, and 320. That is, the at least one secondary cyclone includes two secondary cyclones.

The secondary cyclones 310, and 320 each includes a secondary cyclone body 311, or 321 having a second inlet 312, or 322 in a predetermined portion of an outside circumferential surface, and a first guide member 313, or 324 for guiding air to an inside circumferential surface of the secondary cyclone body 312, or 321.

It is preferable that the secondary cyclone body 311, and 322 are provided in the dust container in an up/down direction, and the second inlets 312, and 322 each is formed by passing through a portion of an upper outside circumferential surface of the secondary cyclone body 311, or 321 in a radial direction.

The secondary cyclone body 311, and 321 each has a cylindrical shape, or a substantially cone shape with a cross sectional area Which becomes the smaller as it goes to a lower side the more.

Of course, the secondary cyclone body 311, and 321 each may have a shape that is a combination of above two shapes. For an example, alike the embodiment, the secondary cyclone body 311, and 321 each may substantially include a cylindrical upper body, and a lower body having a cross sectional area which becomes the smaller as it goes to a lower side. The lower body has an opened bottom for serving as a dust discharge opening.

It is preferable that the secondary cyclones body 310 and 320 are formed as one body with the upper cover 112, for mounting/dismounting on the dust container body 111 together with the upper cover 112.

The second inlets 312, and 322 and the first guide members 313, and 323 are positioned at an upper portion of the upper cover 112. The first guide member 313, and 323 each guides the air from the primary cyclones 210, or 220 to a tangential direction of an inside circumferential surface of the secondary cyclone body 311, or 321, to form a spiral movement of the air in the secondary cyclone body 311, or 321.

For this, the first guide member 313, or 323 has one end connected to a circumference of the second inlet. Accordingly, the secondary cyclone unit has two first guide members 313, and 323.

In addition to above, the secondary cyclone body 311, and 321 may have third inlets 314, and 324 in outside circumferential surfaces respectively, for making air circulating force in the secondary cyclone body 311, and 321, for improving a dust separating performance.

The third inlets 314, and 324 are formed in an upper outside circumferential surface of the secondary cyclone body 311, and 321 at positions spaced away from the second inlets 312, and 322 in circumferential directions, respectively. Though it is preferable that the third inlets 314 and 324 are positioned opposite to the second inlets, the positions of the third inlets 314 and 324 are not limited to this.

There are second guide members 315, and 325 each provided to an outside circumferential surface of the secondary cyclone body 311, or 321 extended from one side circumference of the third inlet 314, or 324 for guiding an air flow to an inside of the secondary cyclone body 311, or 321. Accordingly, one end of the second guide member 315, or 325 is connected to the one side circumference of the third inlet 314, or 324.

Moreover, it is preferable that the third inlet 314, or 324 has the other circumference connected to a third guide member 316, or 326 for forming a flow passage to guide air to the third inlet 314 or 324 together with the second guide member 315, or 325.

For convenience of description, of the second guide members 315, and 325, and the third guide members 316, and 326, ones that are relatively far from the primary cyclones 210, and 220 will be called as second guide members, and ones relatively near to the primary cyclones 210, and 220 will be called as third guide members.

It is preferable that the third guide members 316, and 326 are opposite to the second guide members 315, and 325, respectively.

In the meantime, the two secondary cyclones 310, and 320 may be arranged to be symmetry with respect to a plane.

In this instance, it is preferable that the other ends of the first guide members 313, and 323 of the secondary cyclones 310, and 320 are extended in a direction air from the primary cyclones is to be blowing and connected to each other.

Accordingly, the air introduced to the two secondary cyclones 310, and 320 from the primary cyclones 210, and 220 is split in two sides toward the second inlets 312, and 322 by the first guide members 313, and 323.

It is preferable that the first guide members 313, and 323 are extended between the two secondary cyclones.

Accordingly, the air from the primary cyclones 210, and 220 is accelerated as the air passes between the secondary cyclone body 311, and 321, split by the first guide members 313, and 323, and introduced to the second inlets 312, and 322, respectively.

However, instead of the first guide members 313, and 323, two secondary cyclones may be provided, in which the second guide members 315, and 325 are connected to each other.

The dust container 110 may have a secondary cyclone unit having a plurality of pairs of the two foregoing secondary clones.

It is preferable that above secondary cyclone unit is symmetry in a left/right direction with respect to the plane of symmetry of the dust container 110.

In the meantime, the dust container 110 includes a secondary dust container 131 which forms a secondary dust collecting space. The secondary dust container 131 is provided between a bottom of the secondary cyclone body 311, or 321, and a bottom of the dust container, to form an outside wall of the secondary dust collecting chamber 130.

It is preferable that the secondary dust container 131 is cylindrical substantially, with a bottom in close contact with the bottom of the dust container 110, and a top formed as one body with an outside circumferential surface of a lower portion of the secondary cyclone body 311, and 321.

Therefore, when the bottom of the dust container 110 is opened the dust drops down from the primary dust chamber 120 and the secondary dust chamber 130 by gravity.

However, the secondary dust container 131 may be the bottom formed as one body with the bottom of the dust container 110, and the top in close contact with, the outside circumferential surface of the lower portion of the secondary cyclone body 311, and 321.

In the embodiment, though a number of the secondary dust containers 131 are the same with a number of the secondary cyclones, a number of the secondary dust containers are not limited to this.

For an example, the dust container 110 may include a dust collecting wall (not shown) between the primary cyclone unit and the secondary cyclone unit to divide a space in the dust container 110 into a front dust collecting space, and a rear dust collecting space.

In this case, the. front dust collecting space is the primary dust collecting space, and the rear dust collecting space is the secondary dust collecting space.

In the meantime, it is preferable that an outside wall of the dust container 110 is formed of a material which can be see-through for enabling determination of an amount of dust in the primary dust collecting chamber 120. Of course, it is preferable that an outside wall of the secondary dust container 110 is formed of a material which can also be see-through.

The air cleaned secondarily at the secondary cyclone unit is discharged to upper sides of the secondary cyclones 310, and 320.

For this, at a top of the cap 113, there are upper outlets 113*a* and 113*b* in correspondence to the secondary cyclones, and on an underside of the top of the cap 113, there is a cylindrical air discharge pipe 327 having a radius smaller than a radius of the secondary cyclone body 311, or 321.

In this instance, it is preferable that the air discharge pipe 327 has the same axis with the upper outlet 113*a,* or 113*b* and the secondary cyclone body 311, or 321, is formed as one body with the cap 113, and is projected downward.

The operation of the vacuum cleaner having the dust collecting device 100 applied thereto will be described.

Upon putting the vacuum cleaner into operation, external air introduced to the suction flow passage of the cleaner body through the suction nozzle and the connection pipe is guided by the suction pipe 231, and the guide wall 232, to flow into the two primary cyclones 210, and 220 in a tangential direction of the primary cyclones 210, and 220.

According to this, comparatively heavy, and large particles of the dust are separated by the cyclone principle, and stored in the primary dust collecting chamber 120.

The air cleaned primarily as the comparatively large particles of the dust are separated is discharged to an upper side of the upper cover 112 through the air discharge members 212, and 222 having a plurality of pass through holes and the air outlets 112*a,* and 112*b,* and flows toward the secondary cyclones 310, and 320.

In this instance, the air guided by the first guide members 313, and 323 flows into insides of the secondary cyclone bodies 311, and 321 in a tangential direction through the second inlets 312, and 322, respectively. The air guided by the second guide members 315, and 325 and the third guide members 316, and 326 flows into insides of the secondary cyclones 311, and 321 in a tangential direction, through the third inlets 314, and 324 respectively, to improve an air circulating force.

According to this, comparatively light particles of the dust are separated at the secondary cyclones 310, and 320, and stored in the secondary dust collecting chamber 130.

The air cleaned again at me secondary cyclones 310, and 320 is discharged to an upper side of the cap 113 through the air discharge pipe 327, passes a predetermined air discharge flow passage in the cleaner body and the motor-fan assembly, and is discharged to an outside of the cleaner body.

In the meantime, the dust collecting device of the present invention is applicable both to the canister type vacuum cleaner, and the upright type vacuum cleaner.

It will be apparent to those skilled in the art that various modifications and variations can be made in the present invention without departing from the spirit or scope of the inventions.

Thus, it is intended mat me present invention covers the modifications and variations of this invention provided they come within the scope of the appended claims and their equivalents.

INDUSTRIAL APPLICABILITY

The dust collecting device for a vacuum cleaner of the present invention has the following advantages.

First, the two primary cyclones arranged in parallel improve a dust collecting performance of the primary cyclone unit which separate major portion of dust, to improve ah overall performance of the dust collecting device.

Second the provision of the suction pipe at an upper center of an exterior of the dust container which is symmetric in a left/right direction for guiding air to the primary cyclone unit improves air tightness with the cleaner body, and reduces an air flow resistance.

Third, the primary dust collecting chamber having a cross sectional area greater than a cross sectional area of the primary cyclone unit minimizes influences of a discharge air flow from the primary cyclone unit to a circulating air flow containing dust, thereby improving a dust separating performance.

Fourth, the outside wall of the dust container formed of a material which can be see-through permits easy determination of an amount of dust in the primary duct collecting chamber, thereby permitting to select a time to empty the dust container, appropriately.

Fifth, the plurality of air inlets in an outside circumferential surface of the secondary cyclone body improves an air circulating force, and a dust separating performance.

Sixth, the dust collecting device having the primary cyclone unit with two primary cyclones arranged in parallel on one side the dust container, and the secondary cyclone unit with two secondary cyclones arranged in parallel on the other side the dust container permits an entire structure of the dust collecting device to be compact.

The invention claimed is:

1. A dust collecting device for a vacuum cleaner comprising:

a primary cyclone unit having two primary cyclones arranged in parallel, for separating dust by a cyclone principle;

a secondary cyclone unit haying at least two secondary cyclones which receives air from the primary cyclones on an outer side of the primary cyclones for separating dust by the cyclone principle wherein each of the at least one secondary cyclone includes; a secondary cyclone body in the dust container, having a second inlet in an outside circumferential surface; and a first guide member having one end connected to a circumference of the second inlet for guiding the air from the primary cyclones to a tangential direction of an inside circumferential surface of the secondary cyclone body; and a dust container having the primary cyclone unit and the secondary cyclone unit mounted thereto, and a primary dust collecting space for storing the dust separated at the primary cyclone unit, and at least one secondary dust collecting space for storing the dust separated at the secondary cyclone unit formed therein.

2. The dust collecting device as claimed in claim 1, wherein the dust container has a symmetric exterior in a left/right direction.

3. The dust collecting device as claimed in claim 2, wherein the primary cyclones are connected to a suction air guiding portion which guides air containing dust to the primary cyclones.

4. The dust collecting device as claimed in claim 3, wherein the suction air guiding portion is symmetric with respect to a plane of symmetry of the dust container.

5. The dust collecting device as claimed in claim 3, wherein the primary cyclones are provided in the dust container, and arranged in symmetry with respect to the plane of symmetry of the dust container.

6. The dust collecting device as claimed in claim 5, wherein the primary cyclones are provided in an up/down direction in the dust container.

7. The dust collecting device as claimed in claim 6, wherein the suction air guiding portion includes;

a suction pipe having a suction opening provided to an upper outside circumferential surface of the dust container, and a guide wall for guiding the air guided by the suction pipe to insides of the primary cyclones.

8. The dust collecting device as claimed in claim 7, wherein the primary cyclones each includes a first inlet in an upper outside circumferential surface between the guide wall and the suction pipe for receiving the air guided by the guide wall.

9. The dust collecting device as claimed in claim 8, wherein the guide wall is opposite to the suction pipe, and has one end, and the other end connected to one side circumference of one of the first inlets, and one side circumference of the other one of the first inlets respectively, and a middle portion projected toward the suction pipe for splitting the air supplied by the suction pipe in two sides toward the first inlets.

10. The dust collecting device as claimed in claim 6, wherein the primary cyclones have an upper ends connected to an upper cover openably provided to a top of the dust container, wherein the upper cover has two air discharge holes formed in an up/down direction in correspondence to the primary cyclones.

11. The dust collecting device as claimed in claim 6, wherein the primary dust collecting chamber which forms the primary dust collecting space has an inside circumferential surface surrounding an outside circumferential surface of the primary cyclone unit, and the primary cyclones have bottoms spaced a pre-determined height away from a bottom of the primary dust collecting chamber.

12. The dust collecting device as claimed in claim 11, wherein at least a portion of the outside circumferential surface of each of the primary cyclones is spaced a predetermined distance away from the inside wall of the primary dust collecting chamber, such that the dust passed through a lower end of the primary cyclones spreads along an inside wall of the primary dust collecting chamber.

13. The dust collecting device as claimed in claim 1, wherein the dust container includes an openable bottom which forms a bottom of the secondary dust collecting chamber which forms the secondary dust collecting space.

14. The dust collecting device as claimed in claim 1, further comprising hollow air discharge members provided in the primary cyclones respectively, each having pass through holes of predetermined sizes in an outside circumferential surface for discharging air.

15. The dust collecting device as claimed in claim 1, wherein the at least one secondary cyclone includes two secondary cyclones arranged in symmetry with respect to a plane.

16. The dust collecting device as claimed in claim 15, wherein the first guide members of the two secondary cyclones have the other ends extended to a direction the air from the primary cyclone unit blowing thereto until the other ends are connected to each other, for splitting the air blowing from the primary cyclone unit into two sides toward the second inlets.

17. The dust collecting device as claimed in claim 1, wherein the secondary cyclone unit further includes;

a third inlet in an outside circumferential surface of the secondary cyclone body spaced in a circumferential direction from the first inlet, and a second guide member extended from one side circumference of the third inlet for guiding an air flow.

18. The dust collecting device as claimed in claim 17, wherein the secondary cyclone unit further includes a third guide member connected to the other side circumference of the third inlet to form a flow passage for guiding the air to the third inlet together with the second guide member.

19. The dust collecting device as claimed in claim 1, wherein the dust container includes a secondary dust container provided between an underside of the secondary cyclone body and the bottom of the dust container, to form a secondary dust collecting space.

* * * * *